US007252448B2

(12) United States Patent
Krauskopf et al.

(10) Patent No.: US 7,252,448 B2
(45) Date of Patent: Aug. 7, 2007

(54) PLATEN

(75) Inventors: Angela Krauskopf, Camas, WA (US); Robert M. Yraceburu, Camas, WA (US); Steve O. Rasmussen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 50 days.

(21) Appl. No.: 11/114,637

(22) Filed: Apr. 25, 2005

(65) Prior Publication Data

US 2006/0239751 A1 Oct. 26, 2006

(51) Int. Cl.
*B41J 11/00* (2006.01)
*B41J 29/38* (2006.01)

(52) U.S. Cl. ..... 400/659; 400/648; 101/41; 347/16

(58) Field of Classification Search ..... 347/101–107, 347/1–4, 10, 416, 37; 400/642, 645, 646, 400/656, 659, 661.3, 662; 100/41, 424.1
See application file for complete search history.

(56) References Cited

U.S. PATENT DOCUMENTS

| | | | | |
|---|---|---|---|---|
| 5,717,446 | A | 2/1998 | Teumer et al. | |
| 6,092,891 | A * | 7/2000 | Okubo et al. | 347/104 |
| 6,172,741 | B1 * | 1/2001 | Wotton et al. | 355/73 |
| 6,332,679 | B1 * | 12/2001 | Higuma et al. | 347/102 |
| 6,460,990 | B2 | 10/2002 | Yraceburu et al. | |
| 6,478,492 | B1 | 11/2002 | Crystal | |
| 6,517,179 | B2 * | 2/2003 | Hinojosa et al. | 347/16 |
| 6,672,720 | B2 | 1/2004 | Smith | |
| 2002/0047885 | A1 | 4/2002 | Miyawaki et al. | |

* cited by examiner

*Primary Examiner*—Daniel J. Colilla
*Assistant Examiner*—N. Ha

(57) ABSTRACT

Embodiments of a platen are shown and described.

12 Claims, 5 Drawing Sheets

PLATEN

BACKGROUND

Hygroexpansion of media, such as paper, may occur when a fluid, such as ink, is deposited on the media. This media expansion can be detrimental to inkjet printing systems or to other systems in which a fluid is deposited on media. In some inkjet printing applications media expansion manifests itself as cockle, or wrinkles in the media. However, in some cases, as a result of the media expansion, the media has a tendency to grow by spreading out laterally rather than cockle.

In some inkjet printing systems, multiple passes of ink are laid down on the media. The expansion of the media due to the addition of moisture content from the ink between passes may cause subsequent ink droplets to land in a slightly different position than in the previous pass. This difference in ink droplet placement location between passes can adversely affect print quality.

DETAILED DESCRIPTION

Figure 1:
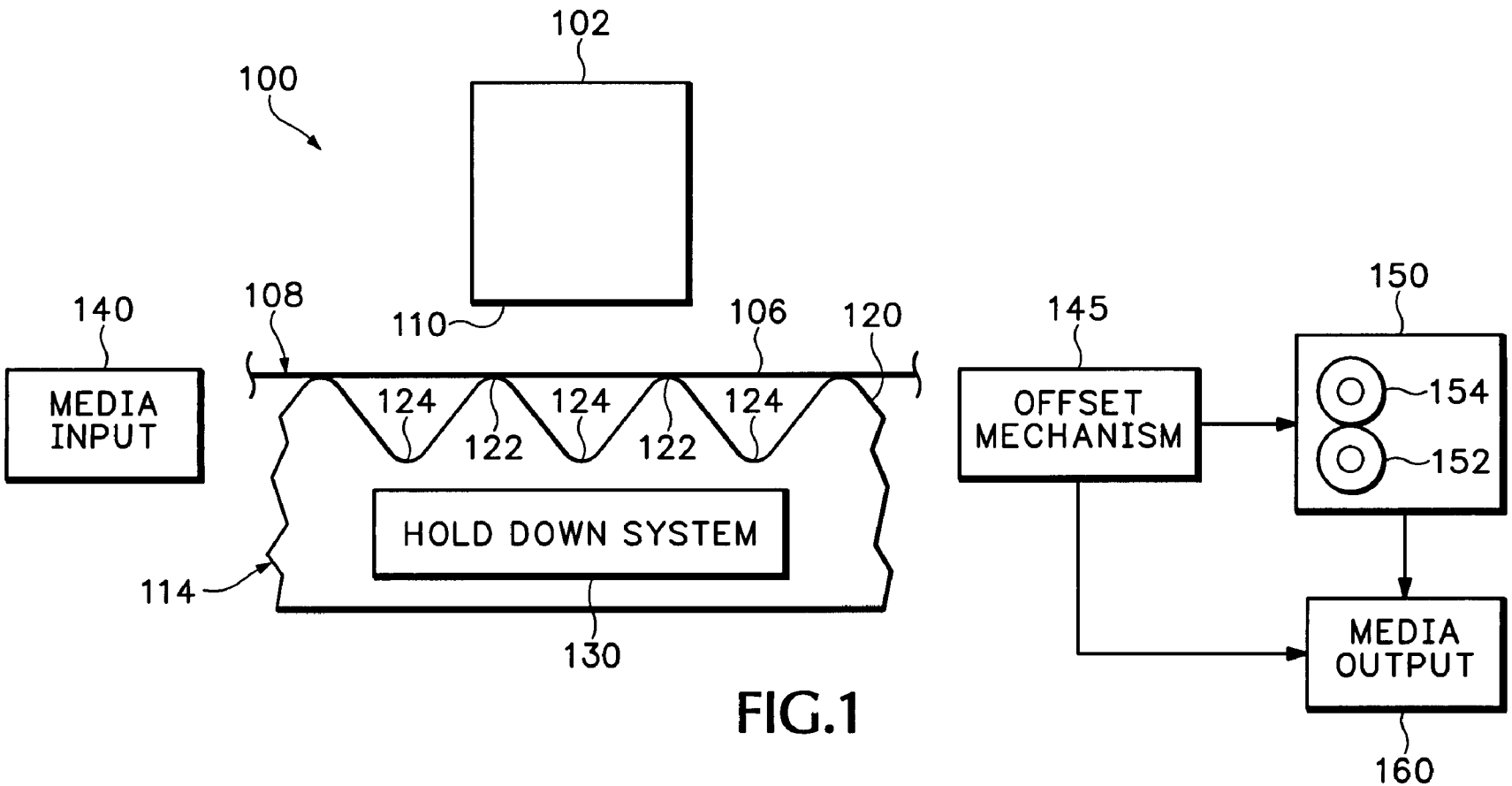
FIG. 1 illustrates a portion of a device according to an example embodiment.

FIG. 1 schematically illustrates a portion of a device 100. The device 100, in some embodiments, may comprise an inkjet imaging device, such as a printer, copier, multifunction device or the like. The device 100 includes one or more fluid ejection devices, such as pen 102, for ejecting fluid, such as ink, onto surface 106 of media 108 supported by a platen 114. The pen 102 includes an array of nozzles 110 through which the pen ejects fluid toward the platen 114. The pen 102 may comprise one or more inkjet pens, which may also be referred to as print cartridges.

The platen 114 may comprise a shuttle, a drum, a belt, or the like and includes an undulating surface 120. The undulating surface 120 includes peaks 122 and valleys 124. The media 108 is held to the peaks 122 of the undulating surface 120 by a hold down system 130. Lightweight media may at least partially conform to the surface 120 due to the force of the hold down system 130. Pursuant to some implementations, lightweight media may dip down into the valleys 124 under the force of the hold down system 130.

Figure 2:
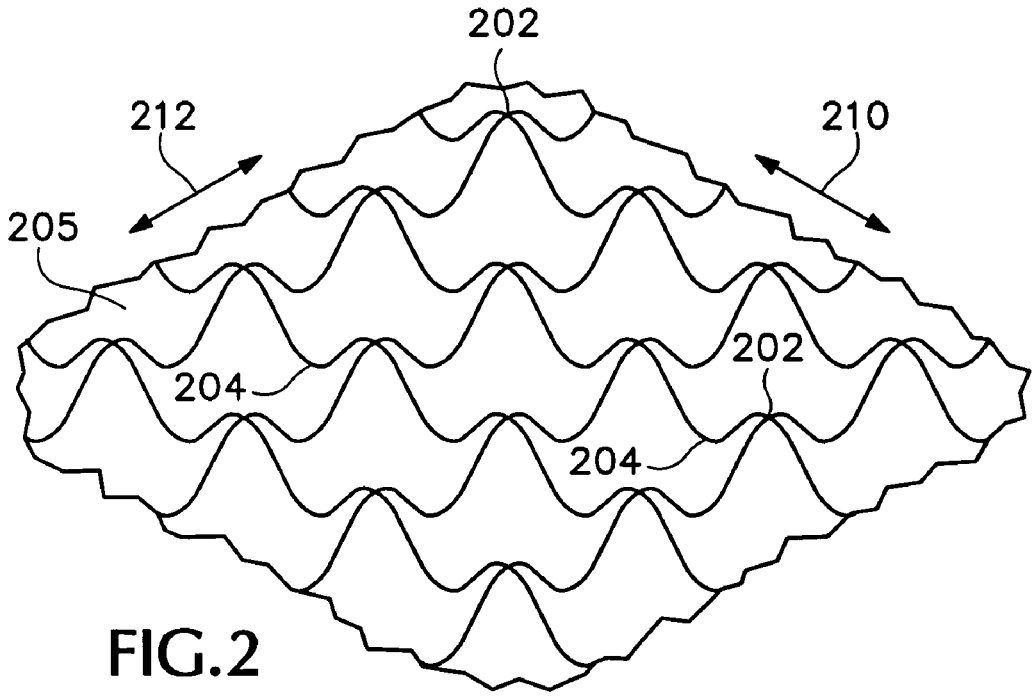
FIG. 2 illustrates a portion of a platen surface according to an example embodiment.

In some embodiments, the surface 120 of the platen 114 resembles a waffle pattern that includes a series of peaks 122 and valleys 124 interleaved in substantially orthogonal directions (see, e.g., FIG. 2). The hold down system 130 comprises a vacuum hold down system in some embodiments and, in other embodiments, comprises at least one of an electrostatic hold down system and capacitive hold down system. Other suitable hold down systems may be alternatively or additionally employed in some embodiments.

Media, such as the sheet of media 108, may be stored at the media input 140. The media input 140 may include, for example, a media input tray and a media handling mechanism for advancing media from the media input tray to the platen 114. The media input 140 may comprise rollers, belts, or other suitable media input system.

In some embodiments, before the pen 102 ejects fluid onto the surface 106 of the media 108, the media 108 is rigid and contacts the peaks 122 of the platen 114 without substantially entering into the valleys 124. The pen 102 then ejects fluid, such as ink, onto one or more portions of the media 108. In some embodiments, the one or more portions of the media 108 on which fluid is deposited by the pen 102 tend to expand after fluid is deposited thereon. Pursuant to some implementations, this media expansion may be regarded as hygroexpansion of the media. In addition, in some embodiments, the deposited fluid may weaken the portion or portions of the media on which the fluid is deposited, thereby reducing the rigidity of such portion or portions.

As the one or more portions of the media 108 on which fluid is deposited expand, are weakened, or both, the media hold down system 130 pulls or urges these one or more portions of the media on which the fluid is deposited into, or further into, one or more of the valleys 124. Drawing these one or more portions of the media on which the fluid is deposited into one or more of the valleys 124 causes the shape of the media 108 to more closely conform to the profile of the undulating surface 120 of the platen 114.

If lighter weight media has already at least partially conformed to the surface 120 before the fluid is deposited thereon, stresses in the lighter weight media are relaxed as the fluid is deposited thereon. This relaxation of the stresses permits the lighter weight media to expand further into the valleys 124 and to more closely conform to the surface 120.

Figure 4:
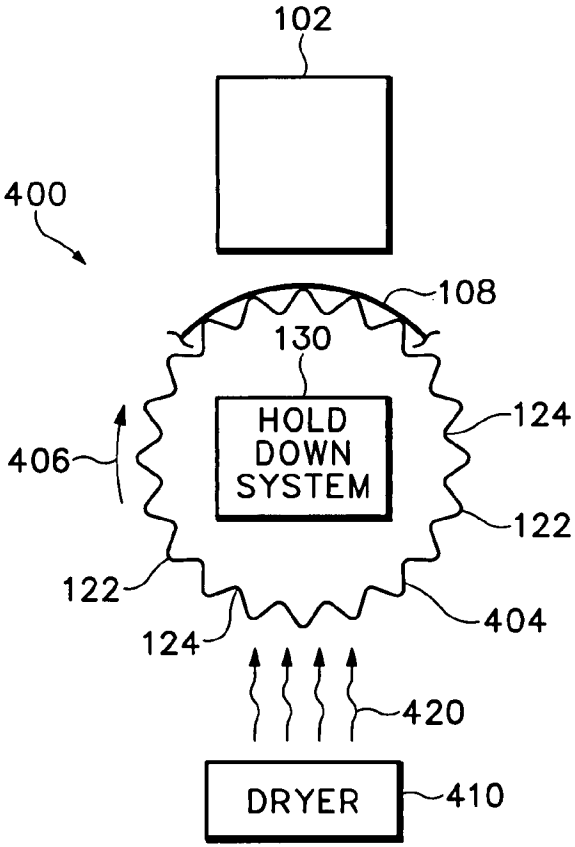
FIG. 4 illustrates a portion of a device including a drum according to an example embodiment.

Hence, movement of the media 108 outwardly, or towards a perimeter of the media 108 is reduced in some embodiments. Because the media 108 has not substantially moved outwardly, a droplet of fluid, such as ink, laid down by the pen 102 in one pass will also land in substantially the same location in a subsequent pass, even though one or more portions of the media 108 have expanded. In some embodiments, the media 108 may be at least partially dried between printing passes. Details regarding an example device that incorporates a dryer is shown in FIG. 4 and described below.

After the pen 102 has completed deposition of fluid on the media 108, or at another time, an offset mechanism 145 advances the media to either a fuser 150 or to a media output 160. In some embodiments, the fuser 150 may advance media to the media output 180. The media output 160 may comprise an output bin or output tray suitable for receiving media and may be configured with one or more rollers or belts to aid in advancing media thereto. In some embodiments, the media 108 may be exposed to a dryer before proceeding to the output. Details regarding an example embodiment including a dryer are shown in FIG. 4 and discussed below.

An optional fuser 150 may be positioned so as to receive media output from the platen 114, such as via the offset mechanism 145. The platen 114, in some embodiments, textures the media by urging the media against the textured surface of the platen 114. The fuser 150 may be used to flatten or otherwise modify the texture of the media output from the platen 114. Hence, in some embodiments, the platen 114 introduces a texture to the media and the fuser 150 at least partially removes or attenuates the texture of the media. In the embodiment illustrated in FIG. 1, the fuser 150 includes opposing rollers 152, 154 that form a nip between them. Media, such as the media 108, is then advanced between the rollers 152, 154. The rollers 152, 154 may flatten or otherwise modify the texture of the media due to the pressure created in the nip, by one or more of the rollers 152, 154 being heated, or by both heat and pressure. In some embodiments, neither of the rollers 152, 154 is heated. The fuser 150 is optional and may not be present in all embodiments.

FIG. 2 is a breakaway view of a portion of an example embodiment of platen 114. As shown, the portion illustrates a surface 205 having a sinusoidal profile in both axial 210 and circumferential 212, such as circumferential, directions. The portion 201 includes peaks 202 and valleys 204. The directions 210 and 12 are orthogonal in some embodiments.

Figure 3:
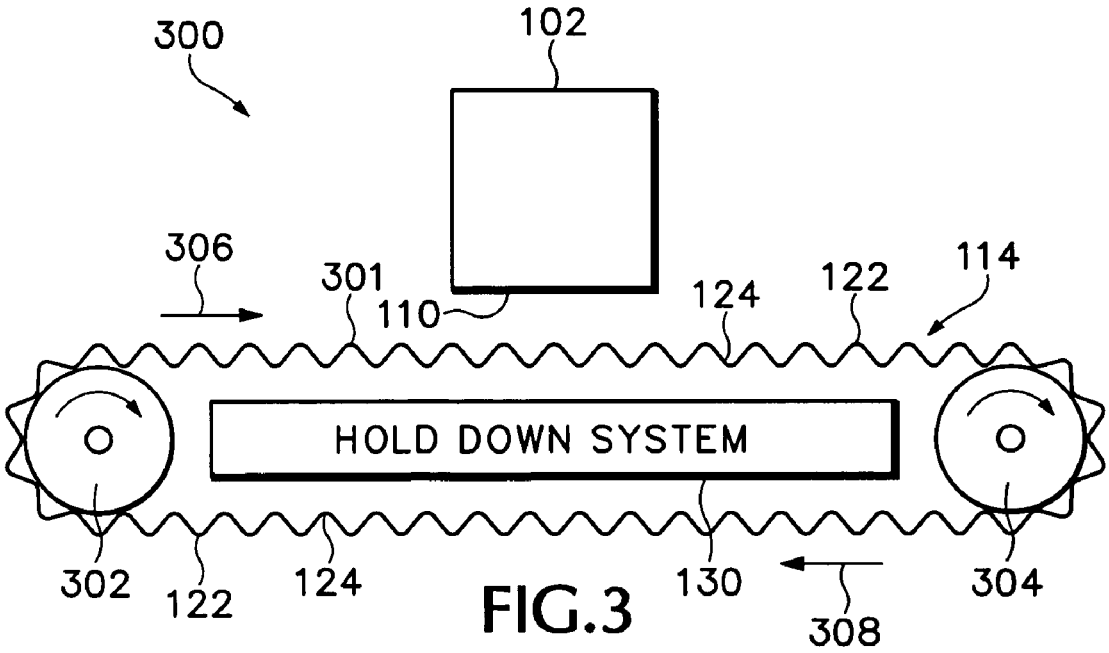
FIG. 3 illustrates a portion of a device including a belt according to an example embodiment.

FIG. 3 illustrates a device 300. The device 300 is identical to the device 100 except as follows. The platen 114 in this embodiment is configured as a belt 301 disposed about rollers 302, 304. The rollers 302, 304 move the belt 301 in directions 306, 308.

FIG. 4 illustrates a device 400. The device 400 is identical to the device 100 except as follows. The platen 114 in this embodiment is a drum 404 configured to rotate in direction 406 to advance media 108 adjacent the pen 102. In some embodiments, the pen 102 will eject fluid on the media 108 a first time, and then the drum 404 continues to rotate to advance the media 108 adjacent dryer 410 where the media 108 may be at least partially dried. The drum 404 then continues to rotate in the direction 406 to bring the media 108 adjacent the pen 102 another time so that the media may be imaged again. The media 108 thus be imaged multiple times during multiple passes of the media adjacent the pen 102. The dryer 410 may comprise a fan or blower configured o advance air 420, such as heated air, across or against the media 108 to aid in drying the media. Hence, the drum 404 may rotate at least 360 degrees between print intervals.

Figure 5:
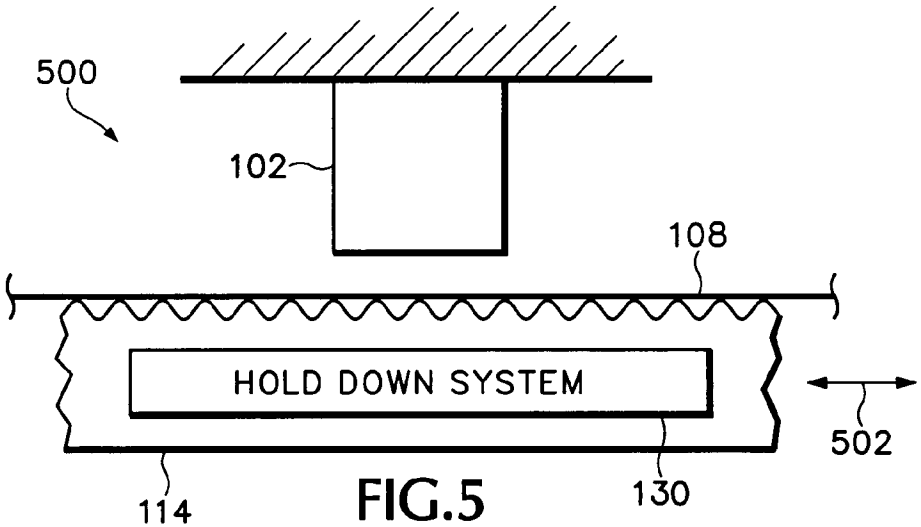
FIG. 5 illustrates a portion of a device having a fixed pen according to an example embodiment.

FIG. 5 illustrates a system 500. The system 500 may be configured identical to the device 100, except as follows. The system 500 is configured such that the media 108 is held to the platen 114 during the period in which the pen 102 ejects fluid onto the media. The pen 102 is held stationary during fluid ejection and the platen 114 moves, or indexes, in directions 502 relative to the pen 102 to move the media relative to the pen 102. In an alternative embodiment, the pen 102 is held stationary during fluid ejection and the platen 114 moves, or indexes, in a direction perpendicular to direction 502. That is, the platen 114 may move, or index, in a direction in or out of the page. Further in other embodiments, the platen 114 may move in the directions 502 and in directions perpendicular to the directions 502 (i.e., in and out of the page).

The hold down system 130 maintains the media 108 in a substantially constant position during fluid ejection or printing. In some embodiments, multi-pass printing may be achieved with the device 500 by moving a portion of the media 108 adjacent the pen 102 multiple times before removing the media 108 from the platen 114.

Figure 6:
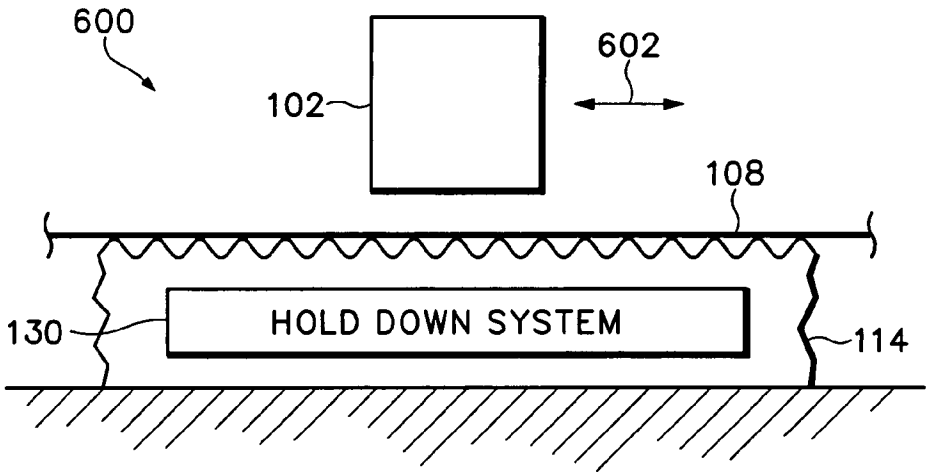
FIG. 6 illustrates a portion of a device having a fixed platen according to an example embodiment.

FIG. 6 illustrates a system 600. The system 600 may be configured identical to the device 100, except as follows. The system 600 is configured such that the media 108 is held to the platen 114 during the period in which the pen 102 ejects fluid onto the media. The platen 114 is held stationary during fluid ejection and the pen 102 moves, or indexes, relative to the platen 114 such that the pen 102 moves in directions 602 relative to the media 108. In some embodiments, the pen 102 may alternatively or additionally move in a directions perpendicular to the directions 602 (i.e., in and out of the page). The hold down system 130 maintains the media 108 in a substantially constant position during fluid ejection or printing. In some embodiments, multi-pass printing may be achieved with the device 600 by moving the pen 102 adjacent a portion of the media 108 multiple times before removing the media 108 from the platen 114.

Figure 7:
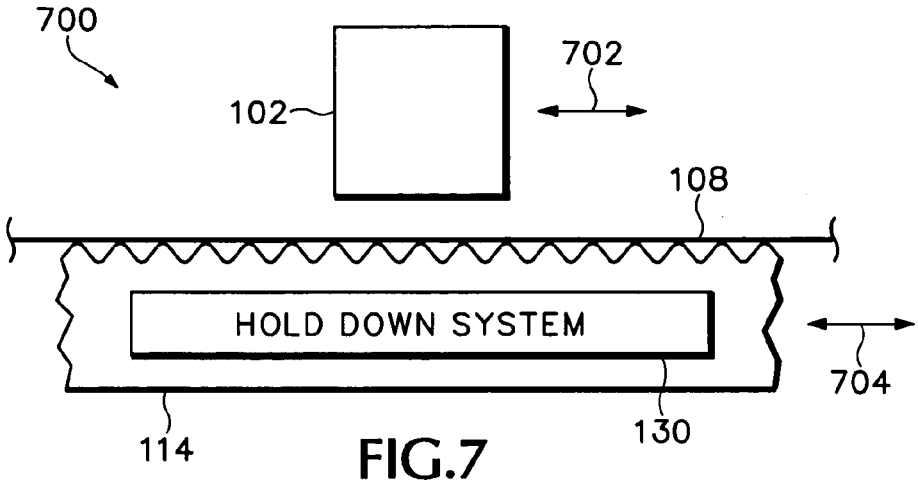
FIG. 7 illustrates a portion of a device having a movable pen and a movable platen according to an example embodiment.

FIG. 7 illustrates a system 700. The system 700 may be configured identical to the device 100, except as follows. The system 700 is configured such that the media 108 is held to the platen 114 during the period in which the pen 102 ejects fluid onto the media. The platen 114 may move in directions 704 during fluid ejection and the pen 102 moves, or indexes, in directions 702 relative to the platen 114 such that the pen 102 moves in relative to the media 108. In alternate embodiments, the platen 114 and/or the pen 102 may additionally or alternately move in directions perpendicular to 704, 702, respectively. In these embodiments, both the pen 102 and the platen 114 move during fluid ejection. The hold down system 130 maintains the media 108 in a substantially constant position during fluid ejection or printing. In some embodiments, multi-pass printing may be achieved with the device 700 by moving a portion of the media 108 adjacent the pen 102, by moving the pen 102 adjacent a portion of the media 108, or both, multiple times before removing the media 108 from the platen 114.

Figure 8:
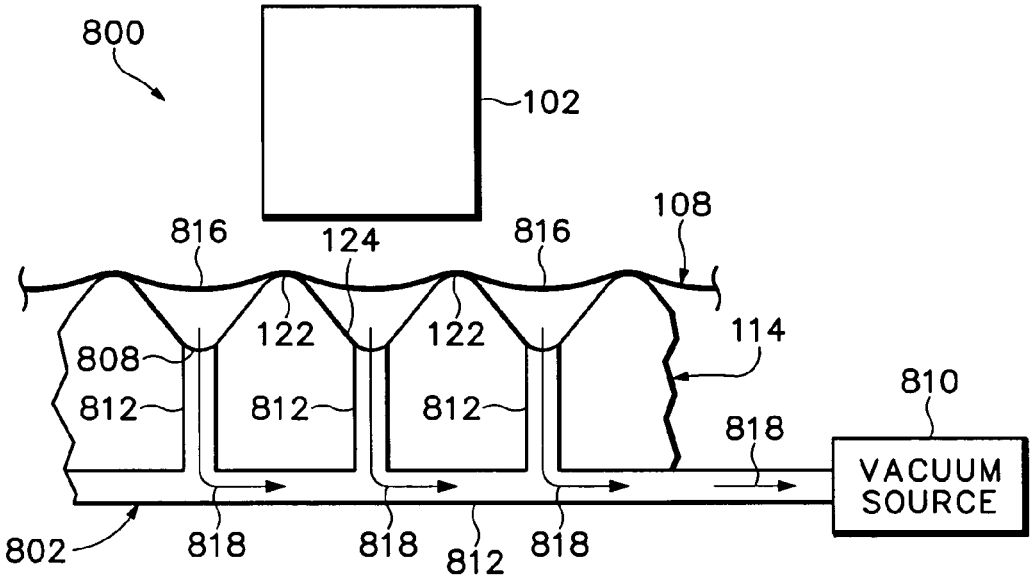
FIG. 8 illustrates a portion of an example vacuum hold down system according to an example embodiment.

FIG. 8 illustrates a portion of system 800 in a sectional view. The system 800 may be configured identical to the device 100, except as follows. The platen 114 is configured with a vacuum hold down system 802. As shown, the vacuum hold down system 802 includes an aperture 808 formed in one or more of the valleys 124 and between adjacent peaks 122. The apertures 808 are in fluid communication via conduits 812 with a vacuum source 810. The vacuum source 810 draws air through the apertures in directions 818 to create a suction force at the surface 120 of the platen 114.

Further, FIG. 8 illustrates the media 108 with portions 816 having fluid (not shown), such as ink, deposited thereon. As shown, the portions 816 are concave and curve toward the platen 114.

Figure 9:
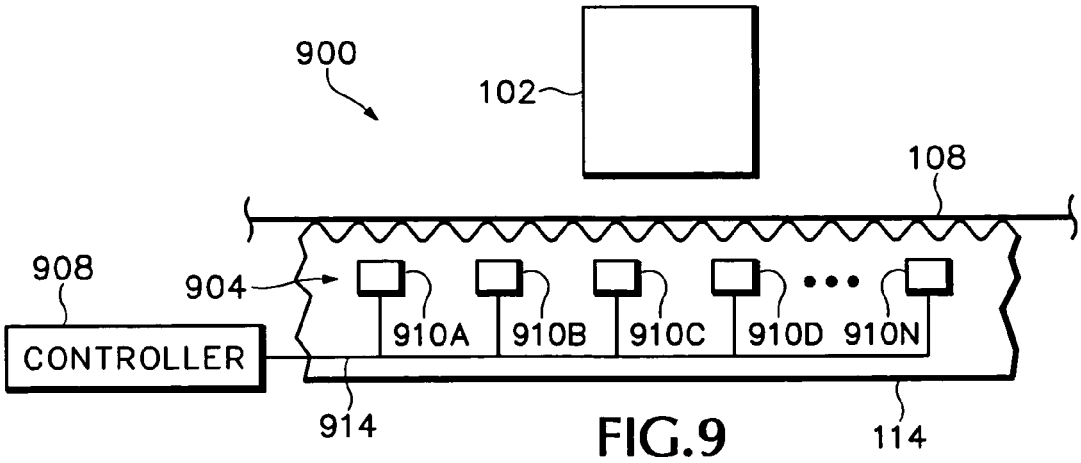
FIG. 9 illustrates a portion of an example capacitive or electrostatic hold down system according to an example embodiment.

FIG. 9 illustrates a system 900. The system 900 may be configured identical to the device 100, except as follows. The platen 114 is configured with an electrostatic or capacitive hold down system 904. The hold down system 904 includes electrodes 910A, 910B, 910C, 910D . . . 910N, which are collectively referred to as electrodes 910. The electrodes 910 are connected to a controller 908 via conductors 914. The controller 908 may include one or more voltage sources and is configured to selectively charge the electrodes 910 so as to create an electrostatic or capacitive force between the media 108 and the electrodes 910, thereby urging the media 108 toward the platen 114.

Figure 10:
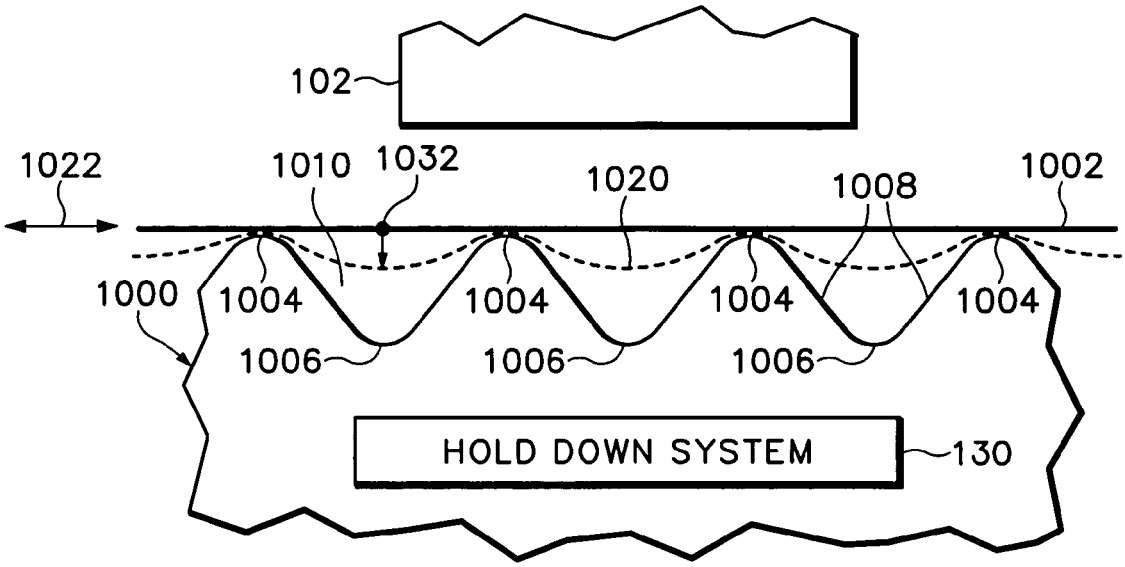
FIG. 10 illustrates dry and wet media on a platen in accordance with an example embodiment.

FIG. 10 illustrates a platen 1000 in accordance with an embodiment. Dry media 1002 is illustrated as being in contact with the platen 1000 at peaks 1004. As shown, the dry media 1002 does not substantially enter into the regions 1010 below the elevation of the peaks 1004 and above valleys 1006. Stated another way, the dry media 1002 does not substantially enter the regions 1010 between undulations 1008. Wet media 1020 is shown in dashed lines and represents the media 1002 after the media 1002 has had a fluid, such as ink, disposed thereon, thereby causing expansion and or weakening of the media 1002. Once wet, portions of the wet media 1020 expand or are weakened so as to be less rigid than dry media 1002. The force from a hold down system, gravity, or both, draws portions of the wet media 1020 into the regions 1020. Permitting the wet media to expand into the regions 1010 prevents or reduces lateral expansion of the media in directions 1022 and/or perpendicular to directions 1022. As such, the lateral position of a point 1032 on the dry media 1002 does not change significantly when the dry media is wet since the point 1032 becomes a part of the wet media 1020 that expands vertically into the region 1010 between undulations 1008. The point 1032 may thus move vertically during media expansion rather than laterally in directions 1022, thereby permitting subsequent drops aimed at point 1032 to be accurately placed.

Figure 11:
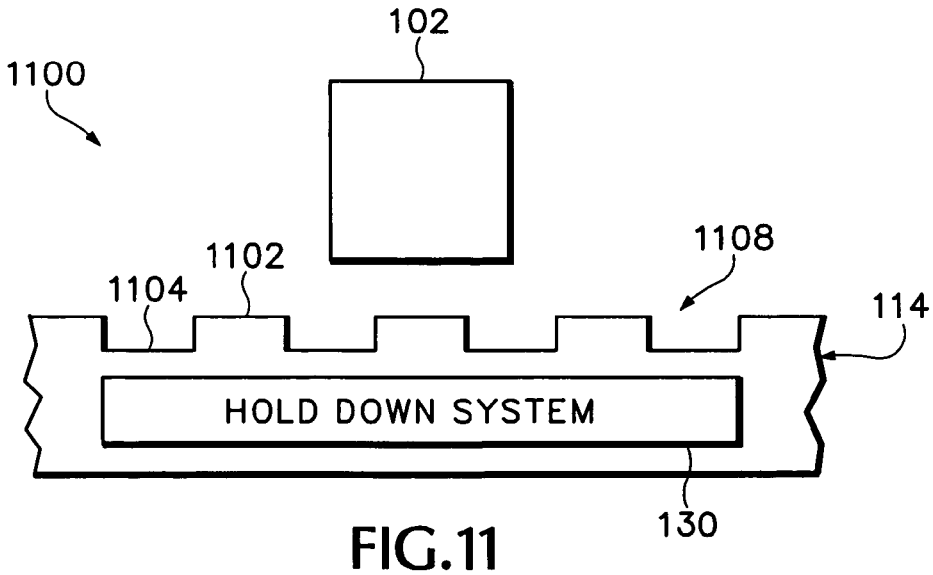
FIG. 11 illustrates a portion of a device according to another example embodiment.

FIG. 11 illustrates a portion of a system 1100. The system 1100 may be configured identical to the system 100 of FIG. 1, except as follows. The platen 114 has a discontinuous top surface 1108 comprised of alternating peaks 1102 and valleys 1104. The platen surface 1108, according to some embodiments, resembles a series of rectangles with discontinuities between adjacent peaks 1102 and valleys 1104. In other embodiments, the valleys 1104 are substantially circular. Pursuant to other embodiments, the peaks 1102 may be substantially circular.

Although the foregoing has been described with reference to example embodiments, workers skilled in the art will recognize that changes may be made in form and detail without departing from the scope of thereof. For example, although different example embodiments may have been described as including one or more features providing one or more benefits, it is contemplated that the described features may be interchanged with one another or alternatively be combined with one another in the described example embodiments or in other alternative embodiments. Unless specifically otherwise noted, the claims reciting a single particular element also encompass a plurality of such particular elements.

What is claimed is:

1. A method, comprising:

positioning a medium on a drum platen, the drum platen having an undulating surface and rotatable about an axis;

first ejecting fluid onto the medium;

rotating the drum at least 360 degrees after the first ejecting;

second ejecting a fluid onto the medium after the rotating;

permitting the medium to expand in a direction radial to the axis after the first ejecting and before the second ejecting.

2. The method of claim 1, further comprising advancing the medium through opposing rollers to flatten the medium after the second ejecting.

3. The method of claim 1, further comprising advancing the medium through a fuser after the second ejecting.

4. The method of claim 1, further comprising blowing air at the medium after the first ejecting and before the second ejecting.

5. The method of claim 1, further comprising urging the medium against the drum platen by vacuum force.

6. The method of claim 1, wherein the undulating surface undulates in a longitudinal direction of the drum and a circumferential direction of the drum.

7. The method of claim 1, wherein the undulating surface has a sinusoidal profile.

8. A method comprising:

positioning a medium on a platen, the platen having an undulating surface including peaks and valleys;

depositing first ink at a portion of the medium;

rotating the platen at least 360 degrees after the depositing the first ink;

expanding the portion of the medium into at least one of the valleys after the rotating;

depositing additional ink at the portion of the medium after the expanding;

maintaining the medium at the platen using a hold down system during the depositing the first ink and the depositing the additional ink.

9. The method of claim 8, wherein the undulating surface undulates in a first direction and in a second direction orthogonal to the first direction.

10. The method of claim 8, wherein the platen comprises a drum.

11. The method of claim 8, further comprising fusing the medium after the depositing the additional ink.

12. The method of claim 8, wherein the hold down system comprises a vacuum hold down system.

* * * * *

UNITED STATES PATENT AND TRADEMARK OFFICE

CERTIFICATE OF CORRECTION

PATENT NO. : 7,252,448 B2
APPLICATION NO. : 11/114637
DATED : August 7, 2007
INVENTOR(S) : Angela Krauskopf et al.

It is certified that error appears in the above-identified patent and that said Letters Patent is hereby corrected as shown below:

In column 2, line 60, delete “180” and insert -- 160 --, therefor.

In column 3, line 44, before “advance” delete “o” and insert -- to --, therefor.

Signed and Sealed this

Nineteenth Day of August, 2008

JON W. DUDAS
*Director of the United States Patent and Trademark Office*